US010385556B2

(12) United States Patent
Norling et al.

(10) Patent No.: US 10,385,556 B2
(45) Date of Patent: Aug. 20, 2019

(54) ADJUSTABLE FLOW LIMITER FOR A MIXING FAUCET AND A METHOD FOR ADJUSTING THE FLOW

(71) Applicant: NGL Teknik i Linköping AB, Linköping (SE)

(72) Inventors: Jacob Norling, Linköping (SE); Hans Nilsson, Västervik (SE)

(73) Assignee: NGL TEKNIK I LINKÖPING AB, Linköping (SE)

( * ) Notice: Subject to any disclaimer, the term of this patent is extended or adjusted under 35 U.S.C. 154(b) by 131 days.

(21) Appl. No.: 15/561,474

(22) PCT Filed: Mar. 1, 2016

(86) PCT No.: PCT/SE2016/050158
§ 371 (c)(1),
(2) Date: Sep. 25, 2017

(87) PCT Pub. No.: WO2016/153409
PCT Pub. Date: Sep. 29, 2016

(65) Prior Publication Data

US 2018/0080204 A1 Mar. 22, 2018

(30) Foreign Application Priority Data

Mar. 23, 2015 (SE) ..... 1530036
Feb. 29, 2016 (SE) ..... 1630040

(51) Int. Cl.
*E03C 1/08* (2006.01)
*E03C 1/086* (2006.01)
(Continued)

(52) U.S. Cl.
CPC ..... *E03C 1/086* (2013.01); *E03C 1/08* (2013.01); *E03C 1/084* (2013.01); *B05B 1/1609* (2013.01);
(Continued)

(58) Field of Classification Search
CPC . E03C 1/086; E03C 1/08; E03C 1/084; E03C 2001/026; B05B 1/1618; B05B 1/1609; B05B 1/1636
See application file for complete search history.

(56) References Cited

U.S. PATENT DOCUMENTS 4,189,099 A * 2/1980 Bruninga ..... B05B 1/12 239/200
6,902,123 B2 * 6/2005 Grether ..... E03C 1/084 239/428.5
(Continued)

*Primary Examiner* — Mary E McManmon
*Assistant Examiner* — Christopher D Ballman
(74) *Attorney, Agent, or Firm* — Mu P.C.

(57) ABSTRACT

A flow limiter (1) for setting a maximum flow of water at an outlet from a mixing faucet, wherein the flow limiter in the axial direction comprises a seat (3 *a,* 3 *b*) which along its periphery is provided with an annular wall (8*a,* 8*b*) and has flow channels (7) arranged inside and along said wall (8*a,* 8*b*), an actuator (30, 50) which is rotatably arranged on the seat (3*a,* 3*b*), a regulating device (20*a,* 20*b*) in the form of a body with a circumferential envelope surface (22, 43) facing the inside of said annular wall (8*a,* 8*b*), wherein the actuator (30, 50) comprises means (34*a,* 34*b*) for moving the regulating device (20*a,* 20*b*) in the axial direction, and wherein an annular cavity is formed between walls formed by the envelope surface (22, 43) of the regulating device and the wall (8*a,* 8*b*) of the seat, in which annular cavity an O-ring (24) is arranged, wherein one of the walls (43, 8*a*) of the annular cavity has open axially extending grooves (9, 44) with a cross-section area increasing in the direction of flow, whereby the O-ring (24) in its plane is adapted to slidably connect to said grooves (9, 44) and to adopt one of predetermined positions in the axial direction along said grooves (9, 44) upon rotation of the actuator (30, 50), and wherein said position corresponds to a maximum flow determined by a cross-section area for channels which is limited by the
(Continued)

O-ring (24) and the walls of the grooves (9, 44) in the plane of the O-ring (24).

13 Claims, 6 Drawing Sheets

(51) Int. Cl.
*E03C 1/084* (2006.01)
*B05B 1/16* (2006.01)
*E03C 1/02* (2006.01)

(52) U.S. Cl.
CPC ..... *B05B 1/1618* (2013.01); *B05B 1/1636* (2013.01); *E03C 2001/026* (2013.01)

(56) References Cited

U.S. PATENT DOCUMENTS 7,374,366 B2 * 5/2008 Tasi ..... E03C 1/084 210/456
7,677,473 B2 * 3/2010 Kao ..... E03C 1/084 239/428.5
7,950,624 B2 * 5/2011 Liao ..... E03C 1/08 222/509
8,708,252 B2 * 4/2014 Blum ..... E03C 1/084 239/428.5
8,757,518 B2 * 6/2014 Kao ..... E03C 1/0412 137/801
9,880,571 B2 * 1/2018 Tempel ..... E03C 1/041
9,982,423 B2 * 5/2018 Zhou ..... E03C 1/084
10,041,235 B2 * 8/2018 Stein ..... E03C 1/084
2008/0111007 A1 * 5/2008 Grether ..... E03C 1/084 239/428.5
2009/0008478 A1 * 1/2009 Grether ..... B01D 35/04 239/428.5
2011/0278380 A1 * 11/2011 Zoller ..... E03C 1/08 239/601
2011/0303309 A1 * 12/2011 Prenzler ..... E03C 1/08 137/551
2013/0075496 A1 * 3/2013 Hart ..... B05B 1/3033 239/428.5
2013/0081730 A1 * 4/2013 Schwartz ..... E03C 1/021 138/44
2014/0217202 A1 * 8/2014 Stein ..... B05B 1/1609 239/392
2016/0024769 A1 * 1/2016 Zoller ..... E03C 1/084 239/407

* cited by examiner

ADJUSTABLE FLOW LIMITER FOR A MIXING FAUCET AND A METHOD FOR ADJUSTING THE FLOW

TECHNICAL FIELD

The present invention relates to regulating devices for controlling water flow in a mixing faucet for, for example, kitchens and bathrooms in dwellings.

PRIOR ART

Mixing faucets for supplying a water flow in water taps in kitchens and bathrooms are normally provided with a lever or hand wheel for controlling the water from a minimum to a maximum value. In this way, the user has been able to completely control the flow according to his own request. Recently, however, an increased awareness about the environment and increased costs for drinking water have contributed to a situation whereby, in this technical field, attempts have been made to find means of avoiding unnecessary utilization of water resources by different ways of limiting the flow in mixing faucets and of adapting the need of flow to the field of application of the mixing faucet. Thus, it is considered that the magnitude of the flow may be different for mixing faucets installed in, for example, kitchens, washrooms (utility rooms), washbasins and showers.

At present, it is common that mixing faucets in installations for a specific purpose are provided with a flow limiter that adapts the flow to the field of application. Thus, in the installation, flow limiters are used which control the flow of water to be, for example, 6 l/min for a mixing faucet in a washbasin, whereas the flow for a mixing faucet in a kitchen may be set at 9 l/min and for a mixing faucet in a washroom at 12 l/min. The prior art flow limiters may be in the form of a washer with a predetermined flow area that determines a specific flow. These flow limiters with specific flows are, within this technical field, made with different colours, where a certain colour corresponds to an embodiment with a certain flow (see e.g. patent document EP 1918465). The flow limiter may either be mounted in the spout (outlet) of the mixer or in a jet collector that is mounted at its outlet.

An installation engineer, when installing a mixing faucet or when updating a mixing faucet, must be equipped with the alternative flow limiters that may be applicable, that is, with flow limiters that have the intended flow (corresponding to a certain colour marking).

For sanitary installations there has been described a control device for outflow from a fitting where both the flow of water or other liquid and the inclusion rate of air in the flow may be regulated. This device is disclosed in patent document US 2011/303309.

DESCRIPTION OF THE INVENTION

One aspect of the present invention is to disclose a flow limiter with adjustable flow for mixing faucets intended for installation in, for example, kitchens, washrooms, bathrooms, showers. The flow limiter may be mounted at the outlet of the mixing faucet, or in a jet collector which is connected to the outlet of the mixing faucet.

A further aspect of the invention is to disclose an adjustable flow limiter for eliminating the need of choosing between different flow-limiting means adapted to the field of application when installing or upgrading mixing faucets, as described above.

Further, the flow limiter according to the invention comprises a function to achieve constant flow also in case of pressure variations in the incoming water of the mixing faucet.

The flow limiter according to the invention may advantageously be installed upstream of a device with means for supply of air to the water flow.

The functions: a) setting of maximum flow and b) constant flow in case of pressure variations, are integrated in the flow limiter.

The adjustability of the flow is arranged, according to one example, such that a tool, for example a screw driver or bits, are used for rotating an actuator in the flow limiter to positions with predefined maximum flows by the flow limiter. Markings indicate which position to set. A slot for the tool is accessible from the outside of the flow limiter when this is detached and removed from its installation at the outlet of the mixing faucet.

As an example, the flow limiter may be arranged for maximizing the flow to three different adjustable values, such as 6 l/min, 9 l/min and 12 l/min By this arrangement, the same flow limiter may be utilized for different fields of application, such as in kitchens, washrooms and in washbasins in bathrooms and toilets, where the choice of maximum flow is made in a simple manner by setting the actuator at the maximum flow that is desired for the specific application. In this way, no differently sized flow-regulating washers for different maximum flows need be brought along by the installation engineer when adapting a mixing faucet to its field of application. As mentioned, such washers which are used in the prior art may possess different colours for defining which flow that applies to the flow-regulating washers.

According to one aspect of the invention, this is characterized by the device in the independent claim 1.

Additional aspects of the invention are disclosed by means of the dependent claims.

A further aspect of the invention is characterized by the method disclosed in independent claim 13.

DESCRIPTION OF EMBODIMENTS

In the following, a number of embodiments of the invention will be described with reference to the accompanying drawings. The drawings show the principle of the invention only schematically and do not claim to show any proportions between different elements thereof according to scale.

Figure 1:
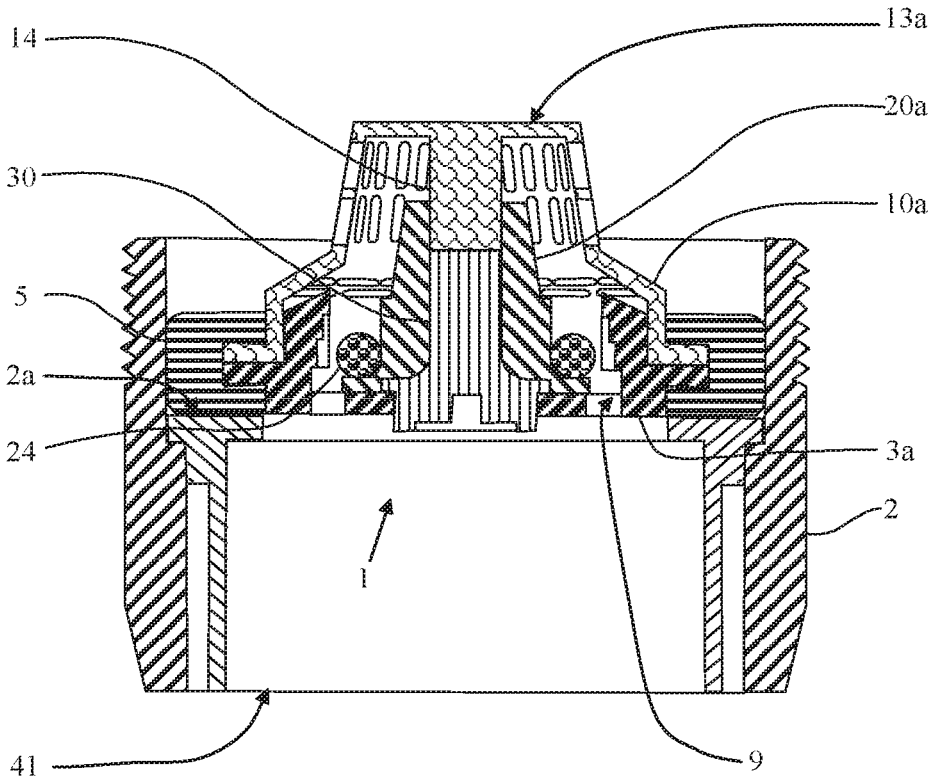
FIG. 1 shows a schematic picture of a first embodiment of a complete flow limiter in its shell according to one aspect of the invention.
Figure 7:
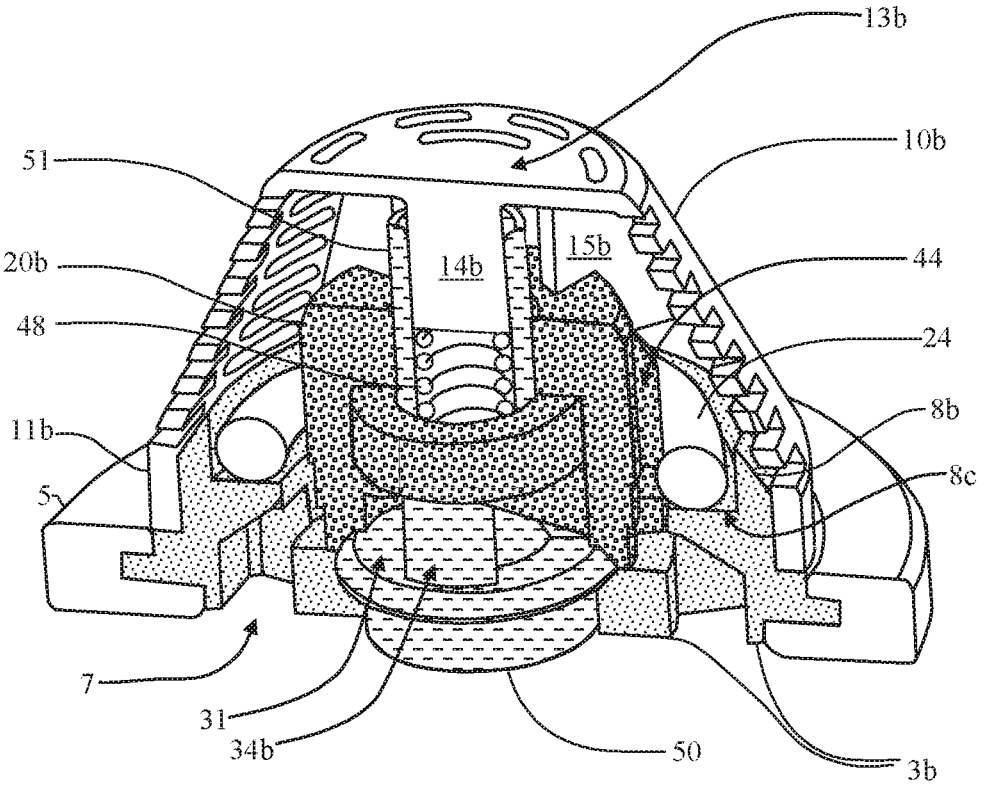
FIG. 7 shows a schematic, exploded view of a second embodiment of the flow limiter. Parts of the regulating device and the actuator are not sectioned.

FIG. 1 and FIG. 7 illustrate a couple of examples of a complete flow limiter according to the invention. As mentioned, a flow limiter 1 according to the invention may be installed at the outlet of a mixing faucet for kitchen, washing room, or bathroom fittings. The outlet may be provided at a fixed outlet pipe from such a mixing faucet, or be located upstream of a jet collector arranged close to such an outlet pipe. In different alternatives for design of a flow limiter 1, said limiter is installed in a cylindrical shell 2 belonging to the mixing faucet or a jet collector.

Inside the shell 2, a seat 3*a*, 3*b* is mounted along a cross section of the shell 2. Along the periphery of the seat 3*a*, 3*b*, a plane flange 4 runs. Around and surrounding the flange 4, a gasket 5 is applied. This gasket 5 actually constitutes the unit that fixes the seat 3*a*, 3*b* inside the shell 2 and determines the position in the axial direction for the seat in relation to the shell 2. In the example shown, the gasket 5 rests on a circumferential shelf 2*a* running along the inside of the shell 2.

The seat 3*a*, 3*b* has a centre hole 6 and is further provided with flow channels 7 which are placed annularly outside and around the centre hole 6. The flow channels 7 permit flowing through the seat 3*a*, 3*b*. An annular wall 8*a*, 8*b* runs around the seat 3*a*, 3*b* at its periphery externally of the flow channels 7 placed in a ring. The wall 8*a*, 8*b* rises from the base plane of the seat, perpendicular thereto, and opposite to the direction of flow (by direction of flow is meant the flow of the liquid that is to flow through the flow limiter).

The figures show a filter head 10*a*, 10*b*. In a first variant of the invention, the filter head with the designation 10*a* has a base 11*a*. In a second variant of the invention, the filter head designated 10*b* has no such base. Instead this second filter head 10*b* is, in its lower part, is shaped with a cylindrical ring 11*b* only, which surrounds the wall 8*b* with press fit. Above and connecting to the base 11*a* and the cylindrical ring 11*b*, respectively, a dome-shaped filter 12 rises. By "above" is meant here opposite to the direction of flow. The dome-shaped filter 12 may be designed in many different ways. By the term dome-shaped is meant all kinds of filter shapes which have a cross-section area decreasing towards the direction of flow. The term dome-shaped shall also comprise the shape of truncated cones. The top part of the dome-shaped filter 12 is preferably flat, but may have other shapes. The filter 12 is provided with holes or meshes along its surfaces. The holes may be elongated, round or oval. In the centre of the flat top part of the dome-shaped filter 2, there is a circular surface 13*a*, 13*b* with or without filter holes.

Inside the filter head 10*a*, 10*b* and resting on the seat 3*a*, 3*b*, there is an essentially annular body which, according to the invention, serves as a regulating device and occurs in two embodiments with reference numerals 20*a* and 20*b*, respectively. Hereinafter, this body will be designated by the term regulating device since it constitutes a component that is used to regulate the flow of the flow limiter 1, which will be described in more detail below. The regulating device 20*a*, 20*b* is located so as to have its longitudinal axis coinciding with the symmetry axes of the shell 2 and the seat 3*a*, 3*b*. Along the axis of the regulating device 20*a*, 20*b*, a cylindrical hole 21 runs. The body of the regulating device 20*a*, 20*b* has on its outside an envelope surface 22, 43 facing the wall 8*a*, 8*b* in the seat 3*a* and 3*b*, respectively. Further, the regulating device 20*a*, 20*b* is adapted to be displaceable in the axial direction, that is, it may be lifted from its position standing on the seat 3*a*, 3*b* and up against the circular surface 13*a*, 13*b* of the filter head 10*a*, 10*b*.

Between the inside of the wall 8*a*, 8*b* in the seat 3*a*, 3 and the envelope surface 22 43 of the regulating device 20*a*, 20*b*, an annular cavity is formed. In this annular cavity, an O-ring 24 is placed in a plane across the symmetry axis of the regulating device 20*a*, 20*b*. The O-ring 24 is arranged to make contact, inside the annular cavity, with the inside of the wall 8*a*, 8*b* with its periphery and to be displaceable in the axial direction in relation to the inside of the wall 8*a* in a first version of the flow limiter 1. In a second version of the flow limiter 1, the periphery of the O-ring 24 is fixed adjacent to the inside of the wall 8*b*, where instead the envelope surface 43 of the regulating device, in this case the regulating device 20*b*, is intended to be displaceable in the axial direction in relation to the O-ring. In this second embodiment, the O-ring 24 is only facing the envelope surface 43 of the regulating device 20*b* with its circular inside, that is, it is not fixed to its envelope surface. Thus, in this second version, the inner diameter of the O-ring is adapted to be able to slide with its inside along the envelope surface 43 of the regulating device 20*b*, when the regulating device 20*b* is displaced in the axial direction. Thus, in the described variants of embodiments, the O-ring 24 is shown to be displaceable in the axial direction relative to the outer wall 8*a* (variant 1) of the annular cavity and to its inner wall 43 (variant 2), respectively.

In the following, a first version of the flow limiter will be described (see FIGS. 1, 5, 6). In this version reference is made to the filter head with numeral 10*a*, since the filter head in this case is formed at its base with a flat annular rim 11*a* along the periphery of the filter head. The filter head 10*a* is connected to the seat 3*a* so that its annular rim 11*a* makes contact with the flange 4 of the seat 3*a*. The annular gasket 5 has a circular slot 5*a* that faces inwardly and is open inwards towards the centre of the gasket. When the filter head 10*a* and the seat 3*a* are brought together so as to make contact with each other, the gasket 5 is arranged such that the flange 4 of the seat 3*a* and the rim 11*a* of the filter head are inserted into the slot 5*a* of the gasket. In this way, the rim 11*a* of the filter head and the flange 4 are pressed tightly together by the gasket 5 which surrounds said rim 11*a* and flange 4 along the circumferences thereof. The gasket 5 will be pressed against said shelf 2*a*, partly by the water pressure, partly, if desired, by an annular elastic insert that is placed in the empty circular space above the gasket 5 in FIG. 1. The insert is pressed against the gasket 5 when the shell 2 is screwed against an outlet pipe for water. This causes the flange 4 of the seat and the rim 11*a* of the filter head to make contact with each other by means of press fit.

From the top part of the filter head 10*a* with the circular surface 13*a*, there extends a cylindrical pin 14 in the direction of flow. The pin 14 is provided with a guide 15, the task of which is to guide a regulating device 20*a*, which is constituted by the above-mentioned body, and which is intended to run axially along the pin 14, whereby the guide 15 may be in the form of a ridge along the outside of the pin 4.

Figure 3:
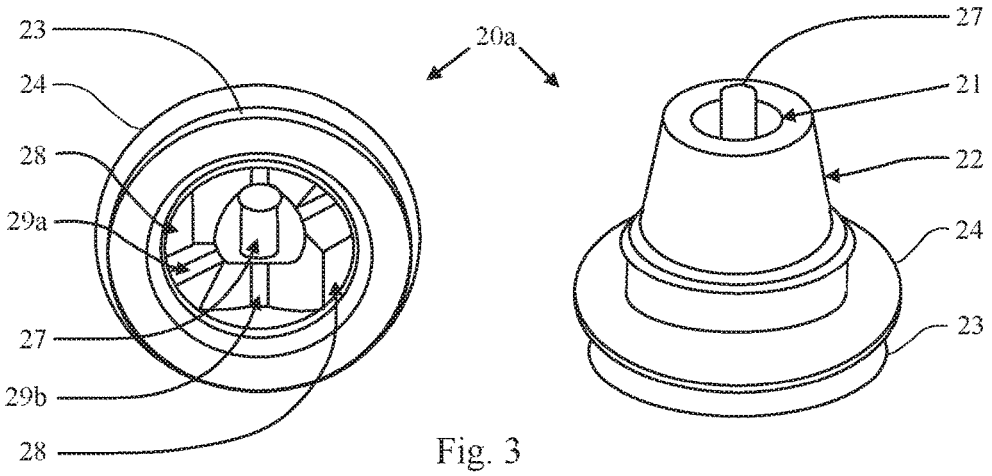
FIG. 3 shows the regulating device of the flow limiter according to FIG. 1 in two perspectives.

In the first variant of the flow limiter 1, the regulating 20*a* (FIG. 3) is designed as a regulating device adapted to be housed in the filter head 10*a*. At its base the regulating device 20*a* has an annular collar 23. In the exemplified embodiment, the regulate device 20*a* has an axial, cylindrical hole 21 which is intended to embrace the pin 4 in the filter head 10*a*, whereby the regulating device 20*a* will be displaced axially along the symmetry axis of the filter head 10*a*. An axially longitudinal recess, a slot 27, in the inner wall of the regulating device 20*a*, in its cylindrical hole 21, is arranged to receive the guide 15, whereby the regulating device 20*a* is unable to rotate in relation to the filter head 10*a* around the symmetry axis which is common to the regulating device 20*a* and the filter head 10*a*. Onto the annular collar 23, the O-ring 24 is applied, the function of which will be described in the following.

Figure 2:
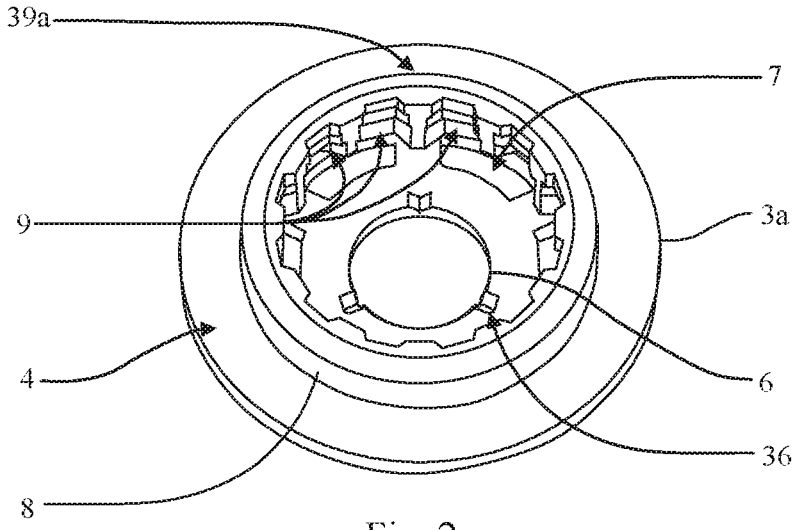
FIG. 2 shows a perspective view of a seat for parts included in the flow limiter according to FIG. 1.

Along the inside of the wall 8*a* (FIG. 2), in the first version, a number of grooves 9 are formed. These grooves 9 are open inwards towards the centre of the seat 3*a* and face the envelope surface 22 of the regulating device 20*a*. The grooves 9 run in the axial direction along the wall 8 of the whole seat. The grooves 9 communicate with the flow channels 7. Preferably, the grooves 9 are equidistant. An important factor according to the aspect of the invention is that the grooves 9 have an increasing cross-section area in the direction of flow. The increasing area of the grooves 9 may, in one embodiment, be achieved by an area which increases in steps (this embodiment being shown in the accompanying figures). Thus, if the flow limiter 1 has three predefined maximum flows, the grooves 9 have three corresponding sizes of their cross-section areas. In the following, the embodiment of the flow limiter 1 is exemplified by three optional maximum flows. However, there is nothing preventing the provision of more optional maximum flows n. The components which then cooperate to set maximum flows are adapted to handle n optional values of desired optional maximum flows. However, the number of possible grooves is limited by the space.

Figure 4:
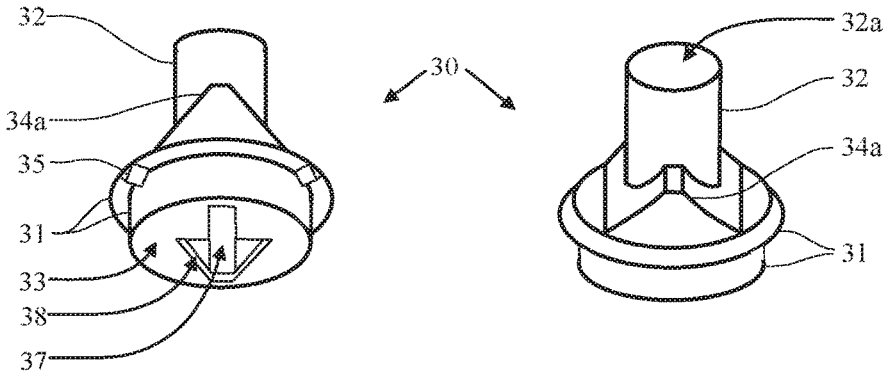
FIG. 4 shows an actuator for the regulating device according to FIG. 3 in two perspectives.

Between the seat 3*a* and the regulating device 20*a* there is arranged an actuator 30 (see FIG. 4). This actuator 30 may be built up with a base plate 31, at the centre of which a circular cylindrical lifting pin 32 is perpendicularly and axially formed, facing the regulating device 20*a* and inserted into the hole 21 in the regulating device 20*a*. The base plate 31 has a smaller diameter on its downstream side facing the seat 3*a* and is adapted such that the part of the base plate 31 with this smaller diameter is immersed into and connects with sliding fit to the centre hole 6 in the seat 3*a*. On that side of the base plate 31 which faces the regulating device 20*a*, the diameter of the base plate is larger and thus a circumferential seam in the base plate 31 is displayed, such that this will function as a tight-fitting lid when the actuator 30 is placed in the centre hole 6 of the seat 3*a*, where the actuator rests on the seat 3*a* in that the circumferential seam rests against the seat. When the maximum flow of the flow limiter is to be set at a desired value, the flow limiter 1 is moved out of its shell 2, whereby that surface 33 of the base plate 31 which faces the seat is visible and accessible from the outside of the flow limiter, since the surface 33 projects through the centre hole 6 in the seat 3*a*. In the normal case, at an already chosen maximum flow for a mixing faucet, the intention is that a user shall not be able to change settings of the flow limiter 1. This will thus be hidden inside further means downstream of the flow limiter 1, such as a netting, jet collector or means for inclusion of air.

The projecting guide pin 32 is arranged to abut, with its end 32*a*, against the lower end 14*a* of the pin 14 in the filter head 10*a* to lift the filter head 10*a* somewhat when setting the maximum flow value. The lift of the filter head 10*a* is enabled by the fact that the base of the filter head 10*a*, i.e. the rim 11*a*, surrounded by the gasket 5, is able to stretch the gasket 5 due to the elasticity thereof. The lifting pin 32 has sliding fit with respect to the inner wall in the cylindrical hole 21 of the regulating device 20*a*, whereby the actuator 30 is rotatably arranged in relation to the regulating device 20*a*. Further, the actuator 30 is rotatable around the common axis of the actuating device and the seat, since the base plate 31 of the actuator 30 may be brought to rotate inside the centre hole 6 in the seat 3.

At the base of the guide pin 32 and externally of the cylindrical guide pin 32 and on the base plate 31, an elevated tongue 34*a* is provided. On the lower side of the regulating device 20*a* (i.e. the downstream side thereof) in an area inside the collar 23, there are diametrically opposed platforms 28 and diametrically opposed first notches 29*a* and diametrically second opposed notches 29*b*. The opposed platforms 28 are flat and are located at a lowest plane in the region of the regulating device 20*a* inside the collar 23, whereas the first notches 29*a* have a first depth in the material of the regulating device 20*a* and the second notches 29*b* a second depth, larger than the first depth, up in the material of the regulating device 20*a*. The notches 29*a* and 29*b* are shaped to correspond to the shape of the tongue 34*a*, which means that the tongue 34*a* may penetrate into the respective notches 29*a*, 29*b*, when the actuator 30 is rotated. In the embodiment, the diameters of the opposed platforms 28, the first notches 29*a* and the second notches 29*b* are displaced 120° in relation to each another around the symmetry axis. This arrangement enables the tongue 34*a* of the actuator 30 to make contact with the platforms 28, hence displacing the regulating device 20*a* to a highest position in relation to the seat 3. When the actuator 30 is rotated 120°, so that the tongue 34*a* penetrates into the first notches 29*a*, the regulating device 20*a* drops down to an intermediate position. Finally, when the actuator 30 is rotated a further 120°, so that the tongue 34*a* penetrates into the second notches 29*b*, the regulating device 20*a* drops down to a lowest position, since the tongue 34*a* penetrates deepest into the interior of the regulating device 20*a* in this position.

Since the platforms 28 and the notches 29*a* and 29*b*, respectively, have different depths, the regulating device 20*a* will be set in the axial direction at one of three different adjustable levels, whereby the regulating device is in its highest position when the tongue 34*a* makes direct contact with the platforms 28 and in its lowest position when the tongue 34*a* is in engagement with the deepest of the notches, that is, the second notches 29*b*. By highest (up) is meant here against the flow direction and lowest (down) means in the flow direction. The consequence of this is that, with the regulating device in its highest position and hence the collar 23 in its highest position, the O-ring 24 on the collar 23 will be on a level with the smallest, according to the example, of three optional cross-section areas of channels which are formed between the grooves 9 and the periphery of the O-ring 24 which makes contact with the inside of the wall 8*a* of the seat. In the midmost position, the O-ring 24 will be on a level with a midmost optional cross-section area of the channels, and consequently a largest optional cross-section area of said channels will be formed when the O-ring 24 is in its lowest position, that is, when the actuator 30 has placed the regulating device 20*a* in its lowest position when the collar 23 thereof rests against the base of the seat 3*a*, For example, the grooves 9 may be formed with areas increasing in steps in the direction of flow to clearly bring about defined cross-section areas for the channels which are formed with the groove 9 and the periphery of the O-ring 24 as delimiter. The actuator 30 is fixed in the set position in the direction of rotation in that bosses 35 in the lower side of the base plate 31 are locked against indents 36 on the upper side of the seat 3*a* close to the centre hole 6. In another embodiment, the choice of areas for the channels may be allowed to be determined in case of continuously increasing cross-section areas of the grooves 9 and be chosen solely by locking of the chosen position of the actuator by means of the bosses 35.

At any of the set maximum flows for the flow limiter, the end 14*c* of the pin 14*a* in the flow limiter 10*a* makes contact with the end 32*a* of the guide pin 32. When readjusting the allowed maximum flow through the flow limiter 1, the actuator 30 will move upwards (the counterflow direction), since the bosses 35 slide up on the surface of the seat 3. In this way, the central surface 13 of the filter head will be slightly pressed up. When the bosses 35 then engage with a set flow position, the bosses 35 are pressed back down against the indent 36 of the seat 3*a*. Thus, the pressure from the filter head 10*a* holds the actuator fixed in the set position.

Here the second version of the flow limiter 1 is described. In this version, reference is made to the filter head with numeral 10*b*, since the filter head in this case at its base is not provided with any collar as in version 1. The base 11*b* is here formed as a cylindrical ring that surrounds a wall 8*b* of the seat 3*b* in assembled position. The wall 8*b*, which extends annularly along the periphery of the seat and is directed opposite the direction of flow from the bottom of the seat 3*b*, has a shelf 8*c* facing inwards towards the centre. On this shelf 8*c*, an O-ring 24 is resting.

The annular gasket 5 has a circular slot 5*a* facing inwards and being open inwards towards the centre of the gasket. The gasket 5 is arranged such that the flange 4 of the seat 3*b* is inserted in the slot 5*a* of the gasket. The gasket 5 will be pressed against said shelf 2*a* in a shell 2 in a manner corresponding to version 1 of the invention.

From the upper part of the filter head 10*b*, with the circularly shaped surface 13*b*, a cylindrical pin 14*b* extends in the direction of flow. The object of the pin 14*b* is to guide an actuator 50 in the axial direction, said actuator having a projection 51 in the form of a cylindrical pipe surrounding the pin 14*b*, whereby the actuator may be displaced axially along the pin 14*b*. The actuator 50 and its function are described in more detail below. From the upper part of the filter head 10*b*, also a number of wings 15*b* extend downwards, that is, in the direction of flow. These wings are adapted to be received by slits 20*d* formed in the axial direction in the regulating device 20*b*, so that this device cannot be rotated around the symmetry axis of the flow limiter 1.

In the second variant of the flow limiter 1, the regulating device 20*b* is formed as an annular body with a central hole 21 passing through it in the axial direction. The annular body, that is, the regulating device 20*b*, has a base 42 and an essentially circular-cylindrical wall 43, also designated the envelope surface of the regulating device 20*b*, along the periphery of the base 42. This circular-cylindrical wall 43 extends from the base 42 upwards in the direction of flow of the liquid which flows through the flow limiter 1. The base 42 faces the base plate 31 of the above-mentioned actuator 50 and is arranged so that the hole 21 receives the projection 51, which extends upwards towards and partially surrounds the pin 14*b* of the filter head 10*b*. The symmetry axes of the regulating device 20*b* and the actuator 50 coincide. The regulating device 20*b* exhibits, along the outer side of the wall, the envelope surface 43, grooves 44 formed in the axial direction, that is, arranged along the direction of flow of a water flow. These grooves 44 are open radially outwards and thus face the O-ring 24 which rests on the shelf 8*c* of the seat 3*b*.

The grooves 44 communicate with the flow channels 7 in the seat 3*b*. Preferably, the grooves 44 are equidistant. An important aspect according to the inventive concept is that the grooves 44 have an increasing cross-section area in the direction of flow. The increasing area of the grooves 44 may, in one embodiment, be achieved by an area which increases in steps (this embodiment being shown in the accompanying figures). Thus, if the flow limiter 1 has three predefined maximum flows, the grooves 44 have thee magnitudes of their cross-section areas corresponding to the maximum flows. In the following, the embodiment of the flow limiter 1 is exemplified by three optional maximum flows. However, there is nothing preventing the arrangement of more optional maximum flows n. The components which thus cooperate to set maximum flows are adapted to handle n optional values of the desired optional maximum flows.

Between the seat 3*b* and the regulating device 20*b*, an actuator 50 is arranged. This actuator 50 may be configured as the actuator 30 in variant 1 of the invention, with the difference that the actuator 50 in variant 2 of the invention has said tubular projection 51, described above, instead of the so-called guide pin 32. The tongue 34*a* in version 1 occurs in version 2 of the invention only on one side of the projection 51, at the base thereof. Otherwise, the function and detailed description of the two variants of actuators 30 and 50 is, in principle, the same, that is, with the function of displacing the regulating device in the axial direction. The actuators 30 and 50, respectively, and their cooperation with the regulating device 20*a* and 20*b*, respectively, thus show means for this displacement of the regulating device 30, 50.

The function for cooperation between actuator 50 and regulating device 20*b* is here described for variant 2 of the invention. This function is best described with reference to FIG. 8 in which the lower side of the regulating device 20*b* is shown in a perspective view.

Figure 8:
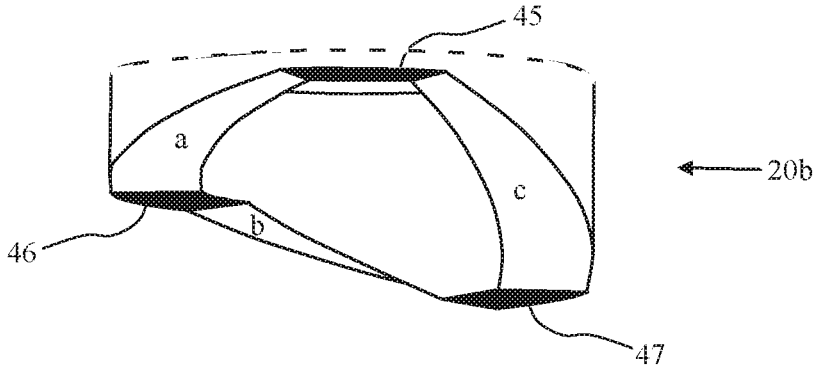
FIG. 8 illustrates the lower part of the regulating device in the second embodiment in a perspective viewed obliquely from below.

FIG. 8 shows that the lower side of the regulating device 20*b* along its periphery 3 has platforms 45, 46, 47 formed to be plane downwards in order to receive and cooperate with the top part of the tongue 34*b*. The tongue 34*b* may be rotated around the axis of the flow limiter 1 and may, in a first position (shown on top in FIGS. 9 and 10), make contact with the top of the platform 45 in the regulating device. In this position of the regulating device 20*b*, the channels which are limited by the walls of the grooves 44 and the O-ring 24 have their smallest cross-section area, the flow limiter 1 thus being set at the smallest of the optional flows, marked with position 1 according to FIG. 10*b*. It is clear from FIG. 10*a* that the gap between the grooves 44 and the O-ring has its smallest width. The flow in this position may correspond to 4 to 5 litres/min.

Figures 10A, 10B:
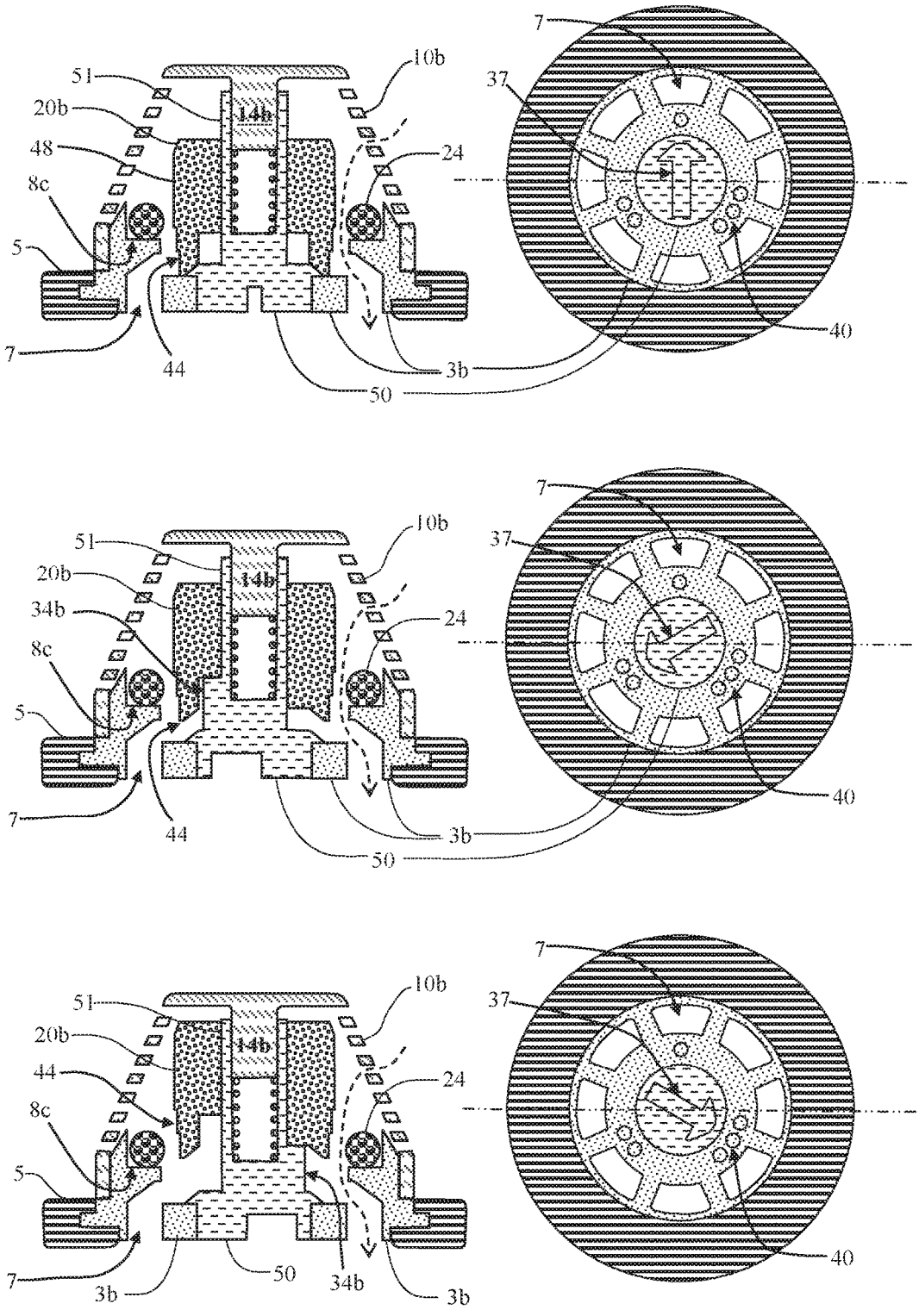
FIG. 10*a* shows pictures in three different positions for the regulating device according to FIG. 7 and constitutes a section which only shows contour lines in the section without showing structures beyond the section. The cutting lines cut right across two diametrically opposite grooves in the regulating device to enhance the clarity of the function.
FIG. 10*b* illustrates the flow limiter as viewed in a plan view from its lower side, where markings for setting the actuator corresponding to the positions of the regulating device according to FIG. 10*a* are shown side by side.

When the arrow 37 at the bottom of the actuator is rotated by means of a tool to position 2 marked with two dots in FIG. 10*b*, the tongue 34*b* will follow path a (FIG. 8) and be lockable such that the tongue 34*b* makes contact with the platform 46 at the bottom of the regulating device. The regulating device 20 will thus drop down to its lower plane in the flow limiter 1 (FIG. 10*a*). In this position of the regulating device 20*b*, the channels which are delimited by the walls of the grooves 44 and the O-ring 24 have their midmost cross-section area, whereby the flow limiter 1 is set at the midmost of optional flows, which may correspond to 6 to 7 litres/min From FIG. 10*b* it is clear that the gap between the grooves 44 and the O-ring has its midmost width.

When the arrow 37 at the bottom of the actuator has been rotated by means of a tool to position 3, marked with three dots in FIG. 10*b*, the tongue 34*b* will follow path b (FIG. 8) and be lockable such that the tongue 34*b* makes contact with the platform 47 at the bottom of the regulating device. This causes the regulating device 20 to fall down to its lowest plane in the flow limiter 1 (FIG. 10*a*). In this position of the regulating device 20*b*, the channels which are delimited by the walls of the grooves 44 and the O-ring 24 have their largest cross-section area, whereby the flow limiter 1 is set at the highest of optional flows, which may correspond to 8 to 9 litres/min (or more depending on the design). From FIG. 10*a* it is clear that the gap between the grooves 44 and the O-ring has its largest width.

Upon rotation of the actuator further from position 3 to position 1, the tongue 34*b* follows path c (FIG. 8) and resumes its position resting against the platform 45. When the actuator has assumed one of its positions 1 to 3, the actuator is locked by the bosses 35 making engagement with indent 36 on the upper side of the bottom of the seat 3*b* close to the hole 6. A spring 48, which is provided between the pin 14*b* of the filter head 10*b* and the internal bottom in the projection 51 of the actuator 20*b*, presses the actuator 50 and the regulating device 20*b* against the seat 3*b*. This also means that, upon rotation, the actuator 20*b* must be forced up a small distance to be clear of the locked position between bosses 35 and indent 36. The spring 48 allows this raising of the actuator so that this may be released from its locked position. When setting a new position 1 to 3 for the actuator, the actuator is locked again by means of bosses 35 and indent 36.

In an alternative embodiment, the setting of the level of the regulating device 20*a*, 20*b* (instead of using tongue 34*a*, 34*b*) may be achieved by the arrangement of a trapezoidal female thread along the envelope surface of the cylindrical guide pin 32 and the envelope surface of the projection 51, respectively. A corresponding male thread is then formed along the cylindrical hole 21 in the regulating device. As an alternative, a projecting pin in the cylindrical hole 21 may follow the female thread, where the pin may be given stop positions at small ledges in the female thread. In a further additional embodiment, a tilting plane is formed in a cut-in spiral along the envelope surfaces of the guide pin 32 and the projection 51, respectively. The last-mentioned pin in the hole 21 may then be adapted to be fixed in a fixed position on ledges arranged and distributed along the tilting plane. When, in these alternative embodiments, the actuator is rotated, the regulating device 20*a*, 20*b* will be displaced in the axial direction by forcing the corresponding male thread, or the pin, in the regulating device 20*a*, 20*b* to move axially by the influence of the female thread, or, alternatively, the tilting plane, in the guide pin 32. The bosses 35 lock the actuator to one of the desired fixed positions according to the above.

In the surface 33 of the actuator 30 which is accessible when the flow limiter 1 is removed from its shell 2, a slot 37 is provided for a tool such as a screwdriver, a wrench or bits, by which the actuator may be rotated with the tool. Further, an arrow-formed marking 38 for a user may indicate the direction for setting an optional maximum flow, where markings 40 corresponding to optional maximum flows may be punched in or provided in some other way in the surface of the seat 3*a*, 3*b* which is visible from the outside.

Figures 5, 6:
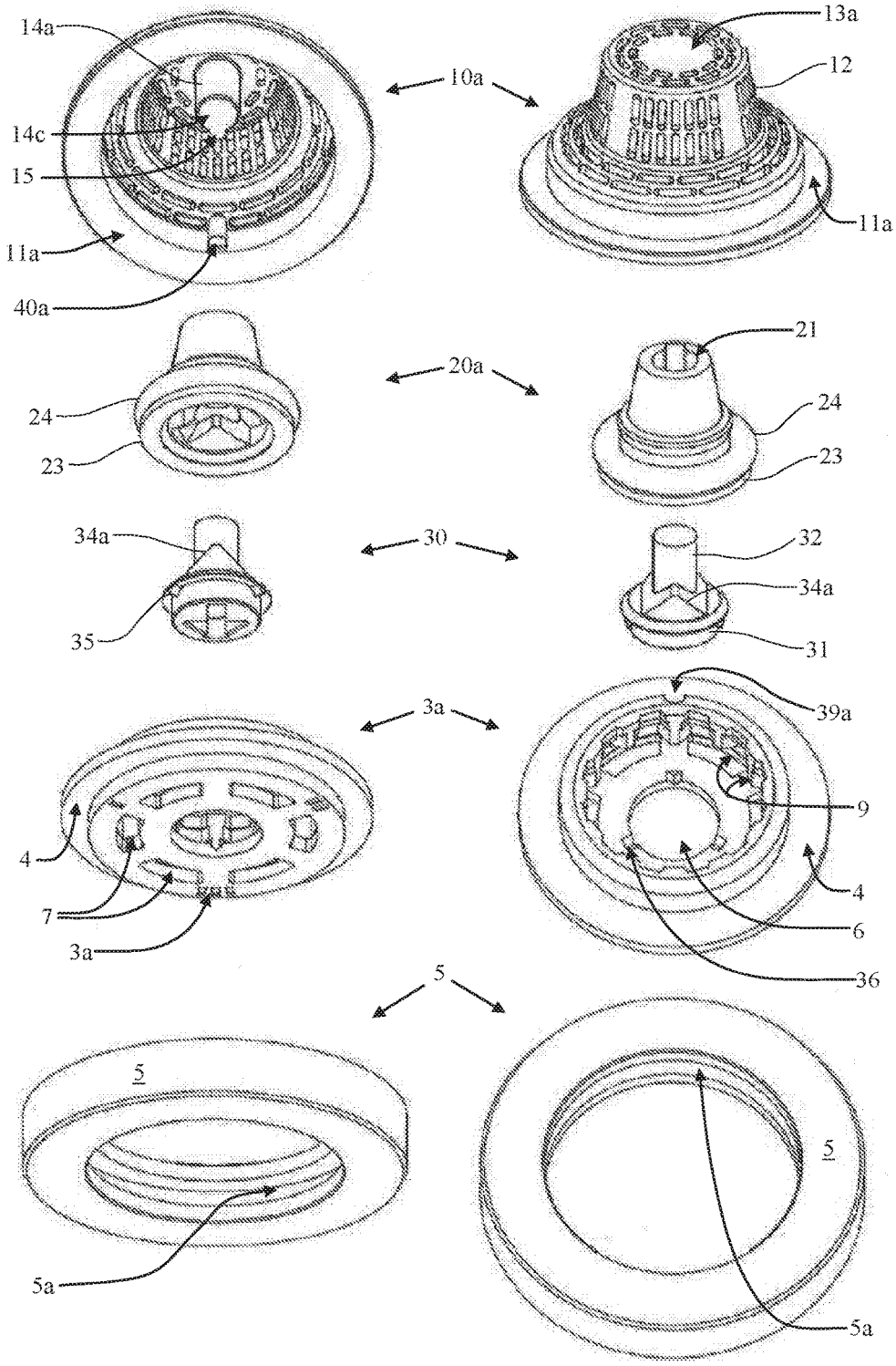
FIG. 5 and FIG. 6 show schematically, in two different perspectives, the components included in the flow limiter according to FIG. 1, aligned along a symmetry line common to the components.

FIGS. 5 and 6 show how the components the filter head 10*a*, the regulating device 20*a*, the actuator 30 and the seat 3*a* are mounted in relation to one another around a symmetry axis common to these components. It can also be realized here that the seat 3*a*, in one position on the outside of the annular wall 8*a*, is provided with a furrow 39*a*. A bulge 40*a* at a position on the inside of the annular base 11*a* of the filter head 10*a* is intended to engage with the furrow 39*a* of the seat 3*a*. In this way, the filter head 10*a* and the seat 3*a* will be locked to each other with respect to rotation around the symmetry axis.

Figure 9:
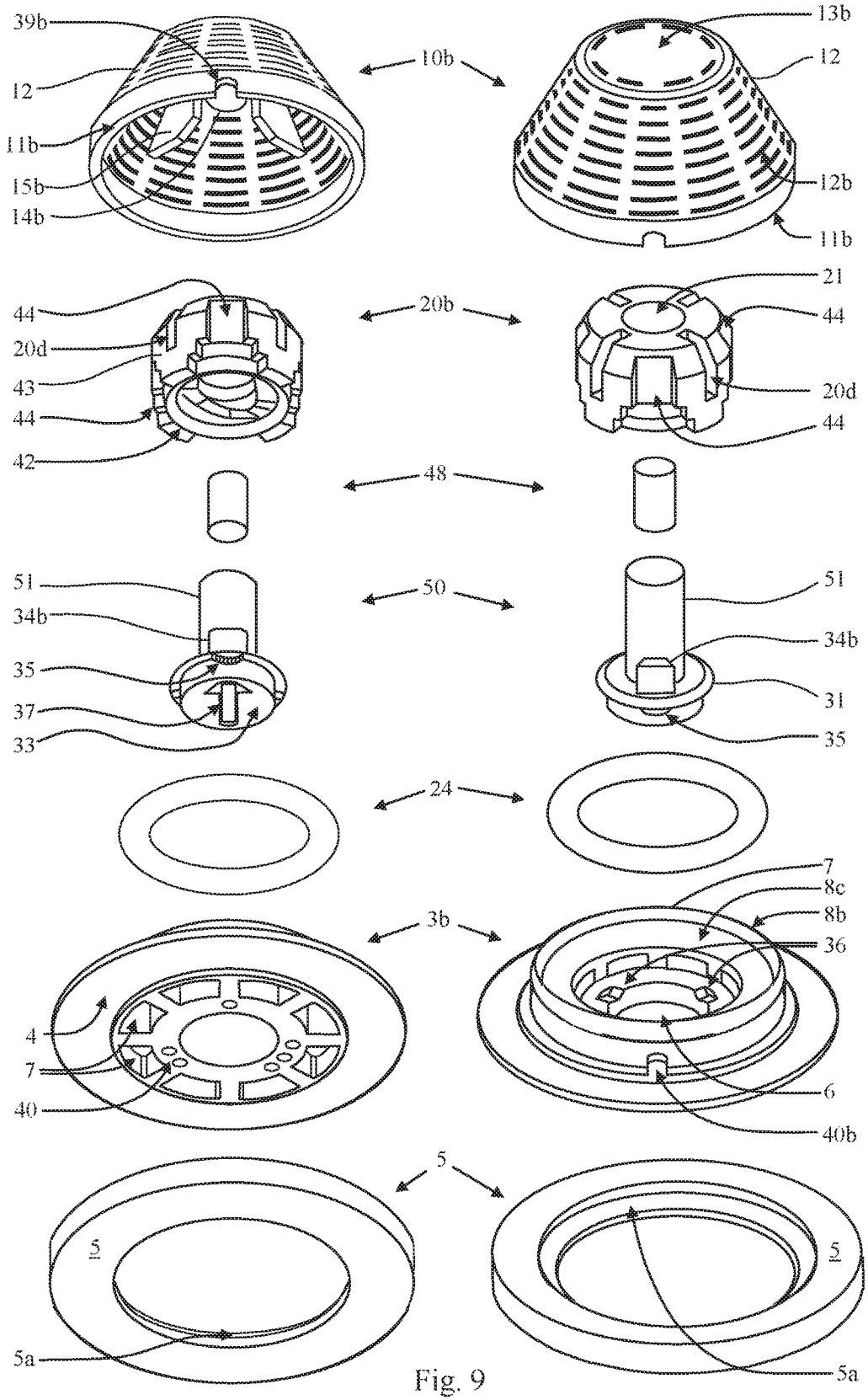
FIG. 9 shows, for the second embodiment of the flow limiter, components corresponding to those of the schematic FIGS. 5 and 6.

FIG. 9 shows how the components filter head 10*b*, regulating device 20*b*, actuator 50 and seat 3*b* are mounted in relation to one another around a symmetry axis common to these components. It can also be realized here that the seat 3*b*, in one position on the outside of the annular wall 8*b*, is provided with a bulge 40*b*. A furrow 39*b* at a position at the bottom of the annular base 11*b* of the filter head 10*b* is intended to engage with the bulge 40*b* of the seat 3*b*. In this way, the filter head 10*b* and the seat 3*b* will be locked to each other with respect to rotation around the symmetry axis.

When water is released through the flow limiter 1, the flow will pass from the upper side of the filter head 10*a*, 10*b* where any foreign matter in the flow is filtered away. The water flows further into the interior of the filter head and flows along the outside of the regulating device 20*a*, 20*b* and down through the channels which are formed by means of the grooves 9 and 44, respectively, and further down through the flow channels 7 in the seat 3*a*, 3*b*. Depending on the setting of the optional positions of the regulating device 20*a*, 20*b*, in the axial direction, the maximum flow of the water is determined.

As can be seen in FIG. 1, the water flows out from the lower side of the flow limiter 1 (i.e. the downstream side thereof) further out towards the outlet 41 of the mixing faucet. The outlet of the mixing faucet may, of course, be connected to other accessories, such as to a jet collector where air is mixed into the water jet downstream of the flow limiter 1. Further, such a jet collector may be capable of being directed with the aid of a ball-and-socket joint according to the prior art. FIG. 1 shows that the shell 22, inside which the flow limiter 1 is arranged, is threaded at its top part, which symbolizes that the shell 2 together with the insert in the form of the flow limiter 1 may be connected to and form an outlet of a mixing faucet.

The adjustable flow limiter 1 may, according to one aspect of the invention, be integrated with a pressure-sensing guide which maintains the set maximum flow. This function is of value, for example in dwellings with several floors, where the water pressure at a higher floor may be considerably lower than at the ground floor of the dwelling. When such pressure differences prevail, the set maximum flow in a mixing faucet at a higher floor would not correspond to what actually is the case. According to the shown device, this is regulated automatically with the aid of the O-ring 24.

At a set maximum position for a flow at a certain water pressure (say 6 bars) at the lowest floor in a dwelling, the water pressure influences the O-ring 24 with a pressure in the direction of flow such that this is compressed and expands both radially outwards and radially towards its centre. This will cause the O-ring 24, in case of increasing water pressure, to bulge inwards somewhat in the grooves, thus decreasing the cross-section area for the channels through which the water is flowing. In case of decreasing water pressure, the situation is the opposite. A certain expansion of the O-ring may be fixed at a certain defined water pressure, for example 6 bars, in which case the desired maximum flow is obtained at the defined water pressure, where the area of said channels inside the grooves 9, 44 is predetermined. Now, if a flow limiter is installed and set at the same maximum flow on a higher floor, for example on the 10th floor of a dwelling, the water pressure there will be lower than 6 bars. In this situation, the lower pressure will mean that the O-ring 24 on the higher floor will not be flattened together to the same extent by the water pressure as the corresponding O-ring 24 on the lowest floor. As a consequence of this, the O-ring 24 on the higher floor in the dwelling will not penetrate to the same depth into the channels inside the grooves 9, 44 as on the lowest floor, which means that the channels at the set value for the maximum flow will automatically have a larger area and hence be compensated for the lower water pressure and thus maintain the set maximum flow. Hence, the flow limiter according to the invention will exhibit both a set maximum flow and automatic correction for varying water pressure in supply pipes for water to the mixing faucet provided with a flow limiter 1 according to the invention.

An additional advantage of the flow limiter according to the above is that the dome-shaped filter 12 has an extension in the axial direction. This means that scrap and dirt collected in the filter 12 are first deposited on the lowest level and from there build up a layer of dirt outside the filter 12, and this layer may in course of time become thick and more or less stop the flow of water. However, it may take a long time before the layer of dirt completely covers the whole filter 12 because of the axial extension of the filter. In most filters according to the prior art, filters are used which have an extension across the flow, whereby stop of flow occurs even at a thin layer of dirt above the filter surface.

The invention is characterized in that it also comprises a method as follows: A method for setting a maximum flow in a mixing faucet provided with a flow limiter 1 for water which may flow through the mixing faucet, wherein the flow limiter across an outlet of the mixing faucet has a seat 3*a*, 3*b* provided with grooves 9, 44 which have an increasing cross-section area in a direction of flow for the water, wherein the method is characterized by the following steps: an actuator 30, 50 is moved to one of a number of optional fixed positions for a maximally allowed flow through the mixing faucet, the actuator 30, 50 thereby forcing a regulating device 20*a*, 20 to be displaced along the grooves 9, 44 and be locked at a position that sets channels between the grooves 9, 44 and the regulating devices 20*a*, 20*b* to be given a total flow area that allows a maximum flow corresponding to the flow at which the actuator is set.

The invention claimed is:

1. A flow limiter (1) for setting a maximum flow of water at an outlet from a mixing faucet, wherein the flow limiter (1) is arranged inside a cylindrical shell (2), characterized in that the flow limiter (1) in the axial direction comprises:

a seat (3*a*, 3*b*) which along its periphery is provided with an annular wall (8*a*, 8*b*) and has flow channels (7) arranged inside and along said wall (8*a*, 8*b*), a filter head (10*a*, 10*b*) upstream of the seat (3*a*, 3*b*) where the filter head surrounds the wall (8*a*, 8*b*) of the seat and exhibits a dome-shaped filter (12) directed against the flow, an actuator (30, 50) which is rotatably arranged on the seat (3*a*, 3*b*), a regulating device (20*a*, 20*b*) which is arranged inside the filter head (10*a*, 10*b*), resting on the actuator (30, 50) and inside said annular wall (8*a*, 8*b*), in the form of a body provided with a through-hole (21) and with a circumferential envelope surface (22, 43) facing the inside of said annular wall (8*a*, 8*b*), wherein the actuator (30, 50) comprises means (34*a*, 34*b*) for moving the regulating device (20*a*, 20*b*) in the axial direction, and wherein an annular cavity is formed between walls which are formed by the envelope surface (22, 43) of the regulating device and the wall (8*a*, 8*b*) of the seat, in which annular cavity an O-ring (24) is arranged, wherein one of the walls (43, 8*a*) of the annular cavity has open, axially extending grooves (9, 44) with a cross-section area increasing in the direction of flow, whereby the O-ring (24) is arranged in its plane to slidably connect to said grooves (9, 44) and to assume one of predetermined positions in the axial direction along said grooves (9, 44) upon rotation of the actuator (30, 50), and wherein said predetermined position corresponds to a set maximum flow determined by a cross-section area for channels, set thereby, which is limited by the O-ring (24) and the walls of the grooves (9, 44) in the plane of the O-ring (24), whereby water can flow through the filter (12), through said channels and further out through the flow channels (7) of the seat (3*a*, 3*b*).

2. The flow limiter according to claim 1, wherein the flow limiter (1) is integrated with a constant-flow regulator in that the flow limiter comprises means for automatic regulation of a set maximum flow independently of variations in the pressure of the water, wherein said means consist of the O-ring (24) which expands at a higher pressure than a guiding value of the water flow, such that the O-ring (24) penetrates deeper into the grooves (9, 44) and hence automatically reduces the set cross-section area of said channels and the opposite situation at a pressure lower than the guiding value of the water flow through the mixing faucet.

3. The flow limiter according to claim 2, wherein a) when said annular cavity is arranged with grooves (9) along the inside of the wall (8*a*) of the seat (3*a*), the O-ring (24) is designed to be supported by an annular collar (23) at the base of the regulating device (20*a*), whereby the O-ring (24) upon rotation of the actuator (30) is slidingly displaced along the grooves (9), b) when said annular cavity is provided with grooves (9) along the wall (8*a*) of the envelope surface (43) of the regulating device (20*b*), the O-ring (24) is designed to rest on a shelf (8*c*) which runs along the inside of the wall (8*b*) of the seat (3*b*), whereupon, during rotation of the actuator (50), the grooves (44) of the regulating device (20*b*) in the axial direction are displaced with sliding contact with the O-ring (24).

4. The flow limiter according to claim 3, wherein the actuator (30, 50) has a base plate (31) which is immersed into a centre hole (6) in the seat (3*a*, 3*b*), whereby a surface (33) of the base plate (31) projects through the seat (3*a*, 3*b*), and wherein a seam in the base plate rests on the edge of the seat (3*a*, 3*b*) around the centre hole (6), whereby the actuator can be rotated relative to the seat (3*a*, 3*b*).

5. The flow limiter according to claim 4, wherein the actuator (30, 50) above the base plate (31), that is, in the counterflow direction, is provided with a tongue (34, 34*b*) which lifts the regulating device (20*a*, 20*b*) to a number of fixed positions in that the tongue upon rotation of the actuator (30, 50) engages with platforms (28, 45, 46, 47) and notches (29*a*, 29*b*), respectively, in that surface of the regulating device (20*a*, 20*b*) which supports the regulating device on the actuator.

6. The flow limiter according to claim 5, wherein the actuator (30, 50) is designed to be rotated around its axis of rotation to any of n fixed positions, thereby displacing the regulating device (20*a*, 20*b*) so that it is axially locked in the axial direction at any of n levels whereby n fixed values of maximum flow may be set, where n is preferably 3.

7. The flow limiter according to claim 6, wherein the actuator (30, 50) in the surface (33) which projects has a slot (37) intended for a tool by which the actuator (30, 50) may be rotated and be locked at an optional position for choosing any of predefined maximum flows, which are indicated by markings (40).

8. The flow limiter according to claim 7, wherein the increasing area of the grooves (9, 44) is increasing in steps.

9. The flow limiter according to claim 8, wherein the filter head (10*a*) in one embodiment has a downwardly-directed pin (14*a*) which penetrates down into the hole (21) of the regulating device (20*a*) and is surrounded by the body of the regulating device (20*a*), wherein the pin (14*a*) with its surface (14*c*) makes contact with the actuator (30) in that the actuator (30) has a guide pin (32) that projects up through the hole (21) in the regulating device (20*a*), whereby the surface (32*a*) of the guide pin abuts the pin (14*a*), whereupon the inherent resilience in the filter head (10*a*) presses the actuator (30) against the seat (3*a*).

10. The flow limiter according to claim 9, wherein the pin (14*a*) has a guide (15) which cooperates with a slot (27) in the inner circular wall of the regulating device (20*a*) in the hole (21), such that the regulating device cannot be rotated when the actuator (30) is rotated.

11. The flow limiter according to claim 8, wherein the actuator (50) has a tubular projection (51) which is slidably surrounded by the regulating device (20*b*) so that said device can be moved along the tubular projection (51) in the axial direction, wherein a central downwardly-directed pin (14*b*) of the filter head (10*b*) penetrates with sliding fit into the interior of the other part of the tubular projection (51), and wherein a spring (48) is arranged inside the tubular projection (51) between the pin (14*b*) and a bottom in the tubular projection (51) of the actuator (50), whereby the spring (48) presses the actuator (50) against the seat (3*b*).

12. The flow limiter according to claim 11, wherein the filter head (10*b*) in one embodiment has downwardly-directed wings (15*b*) which penetrate down into slits (20*d*) in the body of the regulating device (20*b*), whereby the regulating device (20*b*) cannot be rotated when the actuator (50) is rotated.

13. A method for setting a maximum flow in a mixing faucet provided with the flow limiter (1) according to claim 1, characterized in that a maximum flow for water through the mixing faucet is set by rotating the actuator (30, 50) in relation to the seat (3*a*, 3*b*) of the flow limiter (1) to predetermined positions marked on the seat (3*a*, 3*b*), wherein the markings (40) correspond to predetermined maximum flows.

* * * * *